US006213116B1

(12) United States Patent
Swainson

(10) Patent No.: US 6,213,116 B1
(45) Date of Patent: Apr. 10, 2001

(54) WOOD AND MULTI-FUEL BURNING STOVE

(76) Inventor: Adam Swainson, Lower Pulworthy, Highampton, Beaworthy, Devon EX21 5LQ (GB)

( * ) Notice: Subject to any disclaimer, the term of this patent is extended or adjusted under 35 U.S.C. 154(b) by 0 days.

(21) Appl. No.: 09/402,224

(22) PCT Filed: Apr. 28, 1998

(86) PCT No.: PCT/GB98/01079

§ 371 Date: Oct. 1, 1999

§ 102(e) Date: Oct. 1, 1999

(87) PCT Pub. No.: WO98/49497

PCT Pub. Date: Nov. 5, 1998

(30) Foreign Application Priority Data

Apr. 28, 1997 (GB) ..... 9708448

(51) Int. Cl.[7] ..... F24B 5/00
(52) U.S. Cl. ..... 126/76; 126/103
(58) Field of Search ..... 126/500, 76, 103, 126/77, 146, 163 R; 110/298, 299, 300

(56) References Cited

U.S. PATENT DOCUMENTS

| | | | | |
|---|---|---|---|---|
| 3,952,721 | * | 4/1976 | Patterson | 126/506 |
| 4,052,608 | * | 10/1977 | Papenmeier | 362/368 |
| 4,102,318 | | 7/1978 | Runquist . | |
| 4,258,692 | * | 3/1981 | Mackey | 126/60 |
| 4,572,155 | | 2/1986 | Engblom . | |
| 4,677,965 | | 7/1987 | Duerichen . | |
| 4,856,491 | * | 8/1989 | Ferguson et al. | 126/76 |
| 4,883,044 | * | 11/1989 | Levesque | 126/515 |

FOREIGN PATENT DOCUMENTS

| | | | |
|---|---|---|---|
| 880846 | * | 4/1943 | (FR) . |
| 2 512 176 | | 3/1983 | (FR) . |
| 280 035 | | 11/1927 | (GB) . |
| 92 19916 | | 11/1992 | (WO) . |

* cited by examiner

*Primary Examiner*—Ira S. Lazarus
*Assistant Examiner*—David Lee
(74) *Attorney, Agent, or Firm*—Davis & Bujold, P.L.L.C.

(57) ABSTRACT

A wood or multi-fuel stove comprises a primary combustion chamber, a flue duct extending from an upper part of the primary combustion chamber; a grate defining a lower boundary for the primary combustion chamber, the grate extending from the front towards the back of the stove interior and having a front edge juxtaposed with the front of the stove; a secondary combustion chamber located beneath the grate linked to the primary combustion chamber; an inlet path for supplying fresh air to the secondary combustion chamber, the inlet path by-passing the primary combustion chamber; and an outlet path for conveying combustion products from the secondary combustion chamber to the flue, the outlet channel by-passing the primary chamber; the stove being characterized in that: the primary combustion chamber (X) is defined at least on its rear side by an insulated member (12); the grate (1) has: (i) a rear edge off set from the insulated member to leave a gap (G); extending over all, or part of, the width of the grate (1); (ii) a front edge set higher than the rear edge (A) so that the grate (1) slopes down from the front towards the gap (G); and a secondary combustion chamber (C) located beneath the grate (1) and linked to the primary combustion chamber (X) by way of the gap (G).

14 Claims, 1 Drawing Sheet

WOOD AND MULTI-FUEL BURNING STOVE

TECHNICAL FIELD

This invention relates to a wood and multi-fuel burning stove which will burn smoke.

BACKGROUND ART

Burning wood and related fuels efficiently in a domestic stove poses the dilemma of trying, on the one hand, to keep the burning temperature of the fire in the stove as high as possible to maximise the combustion efficiency, whilst upon the other hand, trying to get as much heat as possible from the stove into the room. A further challenge for a stove designer has been to provide for a practical and controllable method of burning combustible components carried in the smoke. Such a process is referred to as 'burning its own smoke' and such components in some fuels can constitute up to fifty percent of the calorific value energy value of fuel burnt in the stove.

In a traditional burning arrangement, with smoke rising from the embers (wood or coal), the temperature of the smoke is not raised sufficiently high to reach the combustion temperature of at least some of the combustible components without the help of a catalyst in the smoke flow path. Such a catalyst is easily damaged irrevocably by components in the smoke arising from burning an unsuitable fuel such as, for example, painted wood.

Stoves have been produced and designed using what is termed a 'down draughter' arrangement, whereby smoke is made to pass downwards, through glowing embers (such as of wood or coal) in a fire bed in the stove, before passing back to the flue. In this way the temperature of the glowing embers is sufficiently high for combustible components of the smoke to be burned. Few, if any, of these down draughter designs have proved both practicable and controllable and as a consequence such stoves have not been popular in the market place. This is despite their promise of much greater burning efficiency, with combustible elements in the smoke energy being converted to heat, and the concomitant benefit of the chimney not becoming coated with condensation products such as soot or tar.

U.S. Pat. No. 4,677,965 (Duerichen) shows a wood and coal burning heater which includes a primary combustion chamber for the controlled burning of a solid fuel positioned above a secondary combustion chamber for the subsequent combustion of combustible gases and pollutants which pass downwardly from the primary combustion chamber. An independent air supply is provided for each of the combustion chambers and air flowing to the primary combustion chamber is controlled to govern the rate of burn. A separate air supply is provided in the secondary combustion chamber and this air upon contact with the combustible gases and pollutants passing downwardly from the primary combustion chamber to cause further or secondary combustion to cleanse the smoke and gas of pollutants prior to discharge. Smoke and exhaust gases leaving the secondary combustion chamber pass first rearwardly and then upwardly along the back of the heater and then forwardly beneath the top surface of the heater prior to discharge to provide increased heat exchange contact between surfaces of the heater and exhaust smoke and gases.

The heater proposed and described by Duerichen is a complicated structure and does not make full use of air flows to promote effective operation of the stove when in use. In addition the flow passages described by Duerichen for the mixed exhaust gasses and what are referred to as 'pollutants' would tend to be readily blocked so serving to adversely affect efficient operation of the stove.

DISCLOSURE OF INVENTION

According to the present invention there is provided a wood or multi fuel stove comprising a primary combustion chamber, a flue duct extending from an upper part of the primary combustion chamber; a grate defining a lower boundary for the primary combustion chamber, the grate extending from the front towards the back of the stove interior and having a front edge juxtaposed with the front of the stove; a secondary combustion chamber located beneath the grate linked to the primary combustion chamber; an inlet path for supplying fresh air to the secondary combustion chamber, the inlet path by-passing the primary combustion chamber; and an outlet path for conveying combustion products from the secondary combustion chamber to the flue, the outlet channel by-passing the primary chamber; the stove being characterised in that:

the primary combustion chamber (X) is defined for the major part of its perimeter (grate 1, its rear side and sides (5) and top (12)) by insulated members;

the grate (1) having:

i a rear edge off set from the insulated rear side (5) to leave a gap (G) extending over all, or part of, the width of the grate (1), ii a front edge set higher than the rear edge (A) so that the grate (1) slopes down from the front towards the gap (G); and a secondary combustion chamber C) located beneath the grate (1) and linked to the primary combustion chamber (X) solely by way of the gap (G).

According to a first preferred version of the present invention the stove is characterised in that the gap (G) is of a size sufficient to allow for ashes and some solids during combustion to fall from the primary combustion chamber(X) downwards through the gap (G), and smoke to pass through gap (G).

According to a second preferred version of the present invention or of the first preferred version thereof is characterised in that the grate (1) provides for extra air for burning to be channelled by the grate configuration to pass into the gap (G) so as to mix with the descending smoke, and so enhance the combustion of the smoke.

According to a third preferred version of the present invention or any preceding preferred version thereof the stove is characterised in that the stove (10) provides for smoke to pass downwards into the secondary combustion chamber (C) and subsequently back to the flue duct (11) by way of a route up either side of the stove (10) through a passage (6) defined between an inner fire box (5) and an outside casing (M) of the stove (10).

According to a fourth preferred version of the present invention or any preceding preferred version thereof the stove is characterised by means (3) provided to enable a primary flow of air to enter the stove-box and pass through a hollow top (7), to pass, or wash, down the inside of a glass panel (4) incorporated in an access door to the interior of the stove (10).

According to a fifth preferred version of the present invention or any preceding preferred versions thereof the stove is characterised by means providing for an additional flow of air to enter the stove (10) and follow a route (1A) under the grate (1), to pass into the gap (G).

According to a sixth preferred version of the present invention or of any preceding preferred version thereof the stove is characterised by a grate (G) of a hollow sandwich type construction.

According to a seventh preferred version of the present invention the stove is characterised in that the primary combustion chamber (X) is bounded by insulation material (5, 12), apart from the front (4), where a glazed panel or access door (4) is located.

According to an eighth preferred version of the present invention or any preceding preferred version thereof the stove is characterised by a window (2) positioned so as to offer a view of burning smoke beneath the grate in the secondary combustion chamber (C). Typically the window (2) is double glazed. Additionally the window (2) can lie in an air flow path enabling an air wash to be directed past the window (2) on its inner side.

BRIEF DESCRIPTION OF DRAWINGS

An exemplary embodiment of the invention will now be described by way of example with reference to the accompanying drawing in which.

MODES FOR CARRYING OUT THE INVENTION

Figure 2:
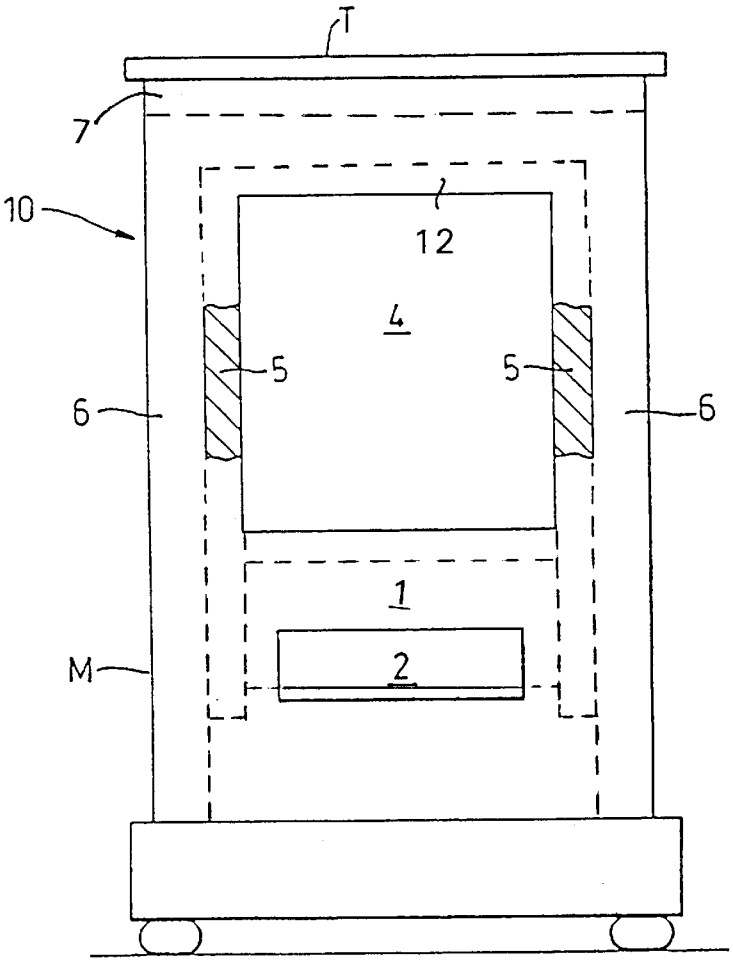
FIG. 2 shows the front view of the stove.
Figure 1:
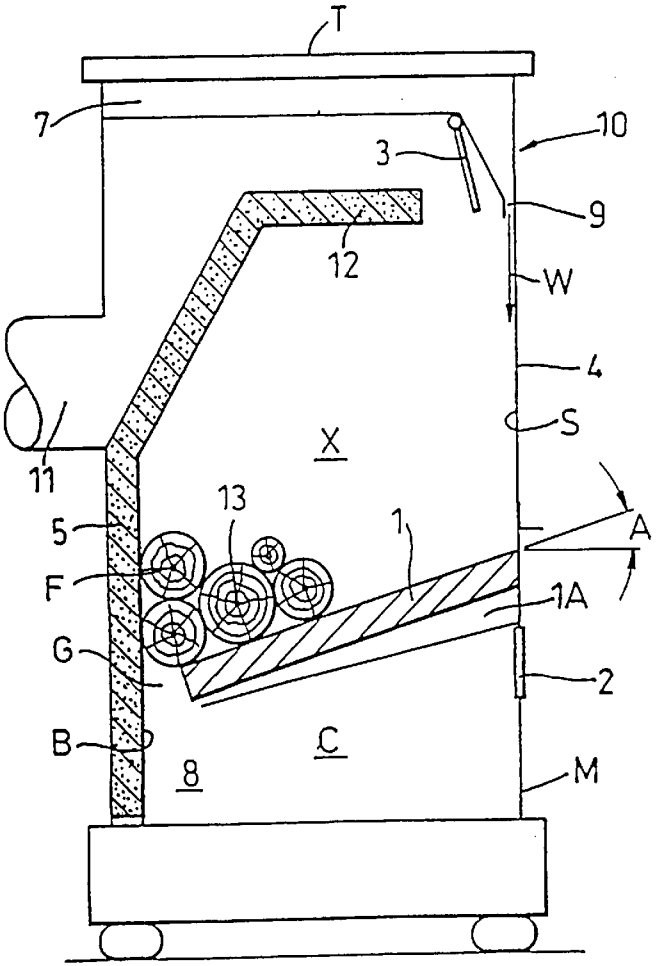
FIG. 1 shows a cross section of the stove from the front to the back.

A wood or multi-fuel stove 10 has a primary combustion chamber X of which the lowest section is formed by a grate 1. The grate 1 has a solid upper surface and hollow middle 1A, and slopes from the front to back B of the stove 10 at a fixed angle A. The grate 1 does not extend right to the back B of the stove but stops short of the back B to form a gap G, running at least part, if not fully across the width of rear side of the grate (1). The gap G opens into a secondary combustion chamber C beneath the grate 1. Fuel 13, in this case lengths of wood, burns in primary combustion chamber X which is in the form of an insulated box 5 (except for the forward facing section) within metal body M of the stove 10.

At top T of the metal body M of the stove is of a hollow channel 7, of sandwich type construction.

The stove 10 is configured so as to work in two modes.

In the first, traditional, mode smoke rises from the fuel 13 in the primary combustion chamber X and passes from thence under and round the baffle 12 and exits to flue 11 by way of flap 3. The flap 3 is shown in an open position pointing towards door 4 to allow the smoke to pass between the door 4 and baffle 12. The combustion products following this path exchanges heat with primary air drawn in through the sandwich type construction lid 7, so pre-heating the primary air. This pre-heated primary air passes into the front part of the primary combustion chamber X through slit 9 to wash over inner surface S of glazed door 4. This air wash flow W serves to keep clean the inner side of the glazed door 4. Smoke from the burning fuel 13 rises and passing under and round the baffle 12 exits to flue 11 via the flap 3.

In the second, down draught, mode the flap 3 is set in the closed position away form the door 4 and touching the front edge of the baffle 12. As a consequence smoke from burning fuel 13 is blocked from following a direct upward route round the baffle 12, to the flue 11, and the stove functions to bum in its down draught mode. In this mode smoke is drawn downwards through burning fuel F and is subsequently mixed with additional pre-heated air, which burns the smoke at region 8 in secondary combustion chamber C located beneath grate 1. This pre-heated air is drawn in via a path through either side of the sandwich type lid 7 down either side of the stove case 10 through a pair of vertical channels to open underneath the grate 1 into hollow passage 1A, from which it emerges into region 8.

The exhaust gasses from the burning at region 8, returns to the flue pipe 11, via a route in the space 6 (FIG. 2) at either side of the stove 10, formed between the outer metal body M and side walls 5 of insulated primary combustion chamber X.

A window 2, is located in the lower part of the stove S to allow a view beneath the grate 1, of the burning smoke in the secondary combustion chamber C, in particular at and around region 8. This window 2 is kept clean by an air-wash system which is a similar to, but a smaller scale version of, the air-wash over door 4.

Typically, the window (2) is double glazed. Additionally the window (2) can lie in an air flow path enabling an air wash to be directed past the window (2) on its inner side.

INDUSTRIAL APPLICABILITY

The present invention provides for a stove of relatively simple construction to be readily operated with high thermal efficiency with a range of readily obtainable fuel without a need for catalytic devices.

What is claimed is:

1. A multi-fuel stove comprising:

a body supporting an insulated primary fuel combustion chamber having a passage for introduction of fuel;

a secondary combustion chamber positioned in the body vertical below the primary fuel combustion chamber;

an access door provided in the body communicating with the passage in the primary combustion chamber to facilitate the addition of fuel to the primary combustion chamber;

a flue outlet communicating with both said primary and said secondary combustion chambers, the flue outlet having a mechanism for isolating the flue outlet from the primary combustion chamber;

a grate having a solid upper surface defining a lower boundary of the primary combustion chamber, the grate comprising a front edge affixed to an interior front wall of the body above a rear edge of the grate so that the grate slopes down from the front edge towards the rear edge, the grate extending back towards an interior rear wall of the body of the stove, and the rear edge is positioned adjacent and spaced from the interior rear wall of the body of the stove to define a gap therebetween;

a pre-heating inlet path for supplying air to the gap in the grate, bypassing the primary combustion chamber; and an exhaust path for conveying combustion products from the secondary combustion chamber to the flue outlet also bypassing the primary combustion chamber.

2. The multi-fuel stove according to claim 1, wherein the gap has dimensions which allow mainly ashes to fall from the primary combustion chamber to the second combustion chamber and provide for the passage of gaseous combustion products from the primary combustion chamber to be drawn downwardly into the secondary combustion chamber.

3. The stove according to claim 1, wherein the structure of the grate provides secondary air for combustion to pass through the grate prior to emerging along the gap whereby the air meets and burns with descending smoke.

4. The stove according to claim 1, wherein the stove provides for combustion products to pass from the secondary combustion chamber to the flue outlet by way of a route extending along at least one side of the stove, this route is formed between outer walls of the body and exterior walls of the primary combustion chamber.

5. The stove according to claim 1, wherein means are provided whereby a primary air flow is drawn into the stove and passes along a preheating route to the primary combustion chamber, where the air flow is drawn to the primary combustion chamber along an inside of a glass window incorporated in the access door.

6. The stove according to claim 1, wherein means are provided whereby a secondary air flow is drawn into the stove and passes along a preheating route to emerge at the gap.

7. The stove according to claim 6, wherein a passage through the grate forms a part of the secondary air preheating route.

8. The stove according to claim 5, wherein the primary combustion chamber is constructed of an insulating material, apart from the front, where the glass window of the access door is located.

9. The stove according to claim 1, wherein the stove has a mechanism arranged, in a first position, to prevent upward access of the combustion products from the primary combustion chamber to the flue outlet.

10. The stove according to claim 9, wherein the stove incorporates a locking mechanism connectable with the access door, to prevent opening of the access door when the stove is operating in a downward burning mode.

11. The stove according to claim 1, wherein the stove has an additional window in the body positioned vertically below the access door for offering a view of burning smoke in the second combustion chamber.

12. The stove according to claim 11, wherein the additional window lies in a flow path enabling an air wash to be directed past the additional window on an inner side of the additional widow to keep the additional window clean.

13. A multi-fuel stove comprising:

a body supporting an upper insulated primary fuel combustion chamber and lower secondary combustion chamber separated by a grate defining a gap;

an access door in the body to allow for the addition of fuel to the primary chamber;

a flue outlet communicating with said primary and secondary combustion chambers, the flue outlet having a mechanism for isolating the flue outlet from the primary combustion chamber;

the grate comprising a front edge and a rear edge and a solid upper surface for supporting a desired amount of combustible fuel in the primary combustion chamber, the front edge being attached to an interior front wall of the body of the stove, the grate extending back towards an interior rear wall of the body of the stove, and the rear edge being adjacent and spaced from the interior rear wall of the body of the stove to define the gap therebetween and the front edge of the grate being affixed to the front wall of the stove body vertically higher than the rear edge so that the grate slopes downwardly from the front edge towards the back edge;

a primary inlet path through which a primary air flow is drawn into the stove and passes on a preheating route to the primary combustion chamber, where the primary air flow is drawn down the inside of a glass window incorporated in the access door into the primary combustion chamber;

a secondary pre-heating inlet path for supplying air to the gap between the grate and the stove, the secondary pre-heating inlet path being defined by a secondary air passage formed between an upper surface and a lower surface in the grate, the secondary air passage communicating with and extending from a first opening in the stove body to a second opening adjacent the gap, bypassing the primary combustion chamber; and an exhaust path for conveying combustion products from the secondary combustion chamber to the flue outlet also bypassing the primary combustion chamber via a a first and second outlet passages communicating with the secondary combustion chamber extending upwardly between a respective first and second side walls of the stove body and the primary combustion chamber.

14. A multi fuel stove having a body formed by a top, a bottom, a front, a back and two sides substantially encompassing a two stage insulated combustion chamber communicating with an air intake and flue passages to provide a desired combustion efficiency, the stove comprising:

an upper primary fuel combustion chamber separated by a sloping grate from a lower secondary combustion chamber, the sloping grate comprising a front edge being attached to an interior front wall of the body of the stove at a vertically higher position than a rear edge of the grate, the grate having a solid upper surface defining a lower boundary of the upper primary combustion chamber for supporting a desired amount of combustible fuel in the primary combustion chamber;

a gap defined by the rear edge of the grate positioned adjacent and spaced from the interior rear wall of the body of the stove;

an access door formed in the body to allow for the addition of fuel to the primary chamber;

a flue outlet communicating with said primary and secondary combustion chambers, the flue outlet having a mechanism for isolating the flue outlet from the primary combustion chamber;

a primary air inlet formed adjacent the top of the body through which a primary air flow is drawn into the stove along a preheating route to the primary combustion chamber, the preheating route passing the primary air flow across a surface heated by an outgoing heated air flow and down the inside of a glass window incorporated in the access door to the primary combustion chamber;

a secondary pre-heating inlet path for supplying air to the gap between the grate and the back of the stove, the secondary pre-heating inlet path being defined by a secondary air passage formed between an upper surface and a lower surface in the sloping grate, the secondary air passage communicating with and extending from a second air inlet in the stove body to a second opening adjacent the gap, bypassing the primary combustion chamber; and an exhaust path for conveying combustion products from the secondary combustion chamber to the flue outlet also bypassing the primary combustion chamber via a a first and second outlet passages communicating with the secondary combustion chamber extending upwardly between a respective first and second side walls of the stove body and the primary combustion chamber.

* * * * *